US007658026B2

(12) United States Patent
Jain et al.

(10) Patent No.: US 7,658,026 B2
(45) Date of Patent: Feb. 9, 2010

(54) WRISTBAND WITH SNAP CLOSURE AND PATENT ID LABEL

(75) Inventors: Sanjay K. Jain, Saint Louis, MO (US); Mark Greer, O'Fallon, MO (US)

(73) Assignee: Laser Band, LLC, St. Louis, MO (US)

( * ) Notice: Subject to any disclaimer, the term of this patent is extended or adjusted under 35 U.S.C. 154(b) by 14 days.

(21) Appl. No.: 11/553,872

(22) Filed: Oct. 27, 2006

(65) Prior Publication Data

US 2008/0098635 A1 May 1, 2008

(51) Int. Cl.
*A44C 5/00* (2006.01)
*G09F 3/14* (2006.01)
*G09F 3/20* (2006.01)

(52) U.S. Cl. ..... 40/633; 40/6; 40/665

(58) Field of Classification Search ..... 40/6, 40/633

See application file for complete search history.

(56) References Cited

U.S. PATENT DOCUMENTS

| | | | | |
|---|---|---|---|---|
| 230,455 | A * | 7/1880 | Wilcox | 40/6 |
| 919,983 | A | 4/1909 | Walsh | |
| 922,948 | A | 5/1909 | Portmore | |
| 1,383,335 | A | 7/1921 | Penksa | |
| 1,517,456 | A | 12/1924 | Pulliam | |
| 2,054,227 | A | 9/1936 | Nichols | |
| 2,073,280 | A | 3/1937 | Lederer | |
| 2,553,676 | A | 5/1951 | Jacob Roos Francois | |
| 2,641,074 | A * | 6/1953 | Richmond | 40/633 |
| 2,687,978 | A | 8/1954 | Vogt | |
| 3,197,899 | A | 8/1965 | Twentier | |
| 3,402,808 | A | 9/1968 | Yannuzzi | |
| 3,660,916 | A | 5/1972 | McDermott et al. | |
| 3,854,229 | A | 12/1974 | Morgan | |

(Continued)

FOREIGN PATENT DOCUMENTS

EP 1039431 9/2000

(Continued)

OTHER PUBLICATIONS

ID Warehouse (http://web.archive.org/web/20050131235601/http://idwarehouse.com/) Jan. 31, 2005. p. 1: WB1908, Stock Vinyl Wristband.*

(Continued)

*Primary Examiner*—Lesley Morris
*Assistant Examiner*—Syed A Islam
(74) *Attorney, Agent, or Firm*—Thompson Coburn, LLP

(57) ABSTRACT

A wristband is assembled from a flexible preferably vinyl carrier and a preferably laminated ID label, the carrier having a panel portion and a strap portion with a snap closure located in a toe extension at the end of the carrier adjacent the panel. The strap has a series of holes, one of which is captured within the snap closure to attach the wristband to the wearer's limb. The laminated ID label has a pair of opposing slots, one of which slips over the strap to abut the panel and the other of which is captured by the snap closure to attach the label to the carrier. The panel portion has a relieved edge formed along its opposing sides which increases the comfort of the wristband as it is worn.

9 Claims, 5 Drawing Sheets

U.S. PATENT DOCUMENTS 4,078,324 A 3/1978 Wiebe
4,179,833 A 12/1979 Knodel
4,226,036 A * 10/1980 Krug ..... 40/633
4,233,715 A 11/1980 McDermott
4,565,731 A 1/1986 Komatsu et al.
4,612,718 A 9/1986 Golub et al.
4,627,994 A 12/1986 Welsch
4,682,431 A 7/1987 Kowalchuk
4,696,843 A 9/1987 Schmidt
4,783,917 A 11/1988 Smith et al.
4,829,604 A 5/1989 Allen et al.
4,854,610 A 8/1989 Kwiatek
4,855,277 A 8/1989 Walter
4,914,843 A 4/1990 DeWoskin
4,956,931 A 9/1990 Selke
4,978,144 A 12/1990 Schmidt et al.
4,991,337 A 2/1991 Solon
RE33,616 E 6/1991 Welsch
5,026,084 A 6/1991 Pasfield
5,045,426 A 9/1991 Maierson et al.
5,135,789 A 8/1992 Schmidt
5,222,823 A 6/1993 Conforti
5,227,004 A 7/1993 Belger
5,227,209 A 7/1993 Garland
5,283,969 A 2/1994 Weiss
5,311,689 A 5/1994 Lindsey
5,318,326 A 6/1994 Garrison
5,351,993 A 10/1994 Wright
5,370,420 A 12/1994 Khatib et al.
5,381,617 A 1/1995 Schwartztol et al.
5,383,686 A 1/1995 Laurash
5,418,026 A 5/1995 Dronzek, Jr. et al.
5,427,416 A 6/1995 Birch
5,486,021 A 1/1996 Laurash
5,486,436 A 1/1996 Lakes
5,509,693 A 4/1996 Kohls
5,509,694 A 4/1996 Laurash et al.
5,518,787 A 5/1996 Konkol
5,524,934 A 6/1996 Schwan et al.
5,547,227 A 8/1996 Laurash et al.
5,560,657 A 10/1996 Morgan
5,581,924 A * 12/1996 Peterson ..... 40/633
5,586,788 A 12/1996 Laurash
5,595,404 A 1/1997 Skees
5,598,970 A 2/1997 Mudry et al.
5,601,222 A 2/1997 Haddad
5,601,313 A 2/1997 Konkol et al.
5,630,627 A 5/1997 Stewart
5,637,369 A 6/1997 Stewart
5,648,143 A 7/1997 Mehta et al.
5,653,472 A 8/1997 Huddleston et al.
5,662,976 A 9/1997 Popat et al.
5,687,903 A 11/1997 Akridge et al.
5,765,885 A 6/1998 Netto
5,785,354 A 7/1998 Haas
5,842,722 A 12/1998 Carlson
5,877,742 A 3/1999 Klink
5,933,993 A 8/1999 Riley
5,984,363 A 11/1999 Dotson et al.
6,000,160 A 12/1999 Riley
6,006,460 A 12/1999 Blackmer
6,016,618 A 1/2000 Attia et al.
6,053,535 A 4/2000 Washburn et al.
6,055,756 A * 5/2000 Aoki ..... 40/633
6,067,739 A 5/2000 Riley
6,071,585 A 6/2000 Roth
6,092,321 A * 7/2000 Cheng ..... 40/633
6,155,476 A 12/2000 Fabel
6,155,603 A 12/2000 Fox
6,159,570 A 12/2000 Ulrich et al.
6,303,539 B1 10/2001 Kosarew
6,331,018 B1 12/2001 Roth et al.
6,343,819 B1 2/2002 Shiozaki
6,361,078 B1 3/2002 Chess
6,409,871 B1 6/2002 Washburn et al.
6,438,881 B1 8/2002 Riley
6,510,634 B1 1/2003 Riley
6,517,921 B2 2/2003 Ulrich et al.
6,641,048 B1 11/2003 Schintz et al.
6,685,228 B2 2/2004 Riley
6,748,687 B2 6/2004 Riley
6,807,680 B2 10/2004 Sloot
6,836,215 B1 12/2004 Laurash et al.
6,863,311 B2 3/2005 Riley
7,017,293 B2 3/2006 Riley
7,017,294 B2 3/2006 Riley
7,047,682 B2 5/2006 Riley
7,222,448 B2 * 5/2007 Riley ..... 40/633
7,240,446 B2 * 7/2007 Bekker ..... 40/633
2002/0176973 A1 11/2002 Keiser
2003/0001381 A1 1/2003 Riley
2003/0003249 A1 1/2003 Benim et al.
2003/0011190 A1 1/2003 Ryan
2004/0068906 A1 4/2004 Riley
2004/0128892 A1 7/2004 Valenti
2004/0244251 A1 12/2004 Riley
2005/0091896 A1 5/2005 Kotik et al.
2005/0108912 A1 5/2005 Bekker
2005/0279001 A1 12/2005 Riley
2006/0230661 A1 10/2006 Bekker
2006/0236578 A1 10/2006 Saint et al.
2006/0242875 A1 * 11/2006 Wilson et al. ..... 40/633
2006/0261958 A1 11/2006 Klein
2007/0089342 A1 4/2007 Jain et al.
2007/0120358 A1 5/2007 Waggoner et al.
2007/0243361 A1 10/2007 Riley et al.
2008/0098636 A1 5/2008 Greer
2009/0094872 A1 4/2009 Ali et al.
2009/0193701 A1 8/2009 Greer

FOREIGN PATENT DOCUMENTS

FR 2806594 A 9/2001
GB 960859 6/1964
GB 2045718 11/1980
GB 2160492 12/1985
GB 2228915 A 9/1990
JP 5-61777 8/1993
JP 08-190350 7/1996
JP 3032299 12/1996
JP 10-207374 8/1998
JP 2002351321 A 12/2002
JP 2003066849 3/2003
JP 2003157010 5/2003
JP 2003164307 6/2003
JP 2006039209 2/2006
WO 9502877 1/1995
WO WO 96/12618 5/1996
WO WO 98/23081 5/1998
WO WO 99/18817 4/1999
WO WO 02/39412 5/2002
WO WO 03/003331 1/2003
WO WO 2004/028826 4/2004
WO WO 2005/064574 7/2005
WO WO 2006/007356 1/2006
WO 2007/021375 2/2007
WO 2009099787 A1 8/2009

OTHER PUBLICATIONS

Avery Dennison DuraCard™.
Avery® Laminated Identification Cards #5361.
Brochure entitled: "Color-Bar® Click Strip™" Label System; Smead Manufacturing Company; Data Uknown; Form No. SSS-CS-00.

Brochure entitled: "Color-Bar® Folders"; Smead Manufacturing Company; Date Unknown.
Brochure entitled: "Integrated Document Management Software"; Smead Manufacturing Company; Date Unknown; Form No. SLI-95.
Catalog entitled: "Reseller Catalog Number One"; Smead Software Solutions™; Date Unknown; Form No. SSS-RC1-00.
Sample of Standard Register Labels.
Standard Register, *P.S. Magazine*, Fall 1998, Dayton, Ohio.
Gretchen Berry, "Wrist Watch," *Advance for Healthcare Information Professionals*, Feb. 15, 1999
Sample of Standard Register Label.
"Yes, Sir, That's My Baby!," *Material Management in Health Care*, Feb. 1999, vol. 8, No. 2, Health Forum, Inc.
Disaster Management Systems Inc., Triage Tag, Copyright 1996, Pomona, California.
Maryland Department of Transportation, Maryland Emergency Medical Services, Triage Tag. Copyright MIEMMS 1999, Maryland.
Posey Movable I.D. Bracelet; downloaded from http:/www.posey.com/products/4648.html on Aug. 18, 2004.
International Search Report for PCT/US2009/031979 dated Mar. 9, 2009.
Office Action for U.S. Appl. No. 11/553,891 dated Mar. 19, 2009.
Office Action for EP Application 03773060.3 dated Aug. 11, 2009.
Office Action for AU Application 2006280450 dated Sep. 14, 2009.
Office Action for U.S. Appl. No. 11/373,923 dated Jun. 1, 2009.
Office Action for U.S. Appl. No. 11/374,273 dated May 26, 2009.
Office Action for U.S. Appl. No. 11/456,928 dated Jun. 15, 2009.
Office Action for U.S. Appl. No. 11/562,114 dated May 6, 2009.
Office Action for U.S. Appl. No. 11/735,078 dated May 28, 2009.
Office Action for U.S. Appl. No. 11/763,615 dated May 6, 2009.
Office Action for U.S. Appl. No. 11/203,601 dated Aug. 17, 2009.
Office Action for U.S. Appl. No. 11/754,812 dated Jul. 24, 2009.
International Preliminary Report on Patentability (Chapter II) for PCT/US2008/059616 dated Jul. 14, 2009.
International Search Report for PCT/US2009/039183 dated Jun. 25, 2009.
Office Action for U.S. Appl. No. 12/026,030 dated Oct. 8, 2009.
Office Action for U.S. Appl. No. 12/252,710 dated Oct. 15, 2009.
Office Action for CN Application 200580019868.5 dated Sep. 4, 2009.

* cited by examiner

WRISTBAND WITH SNAP CLOSURE AND PATENT ID LABEL

CROSS-REFERENCE TO RELATED APPLICATIONS

This application is related to two other applications being filed concurrently herewith. They are "Wristband with Contoured Comfort Sides" having Ser. No. 11/553,873; and "Laminate Web Wristband" having Ser. No. 11/553,891; both of even filing date herewith and the disclosures of which are incorporated herein by reference.

BACKGROUND AND SUMMARY OF THE INVENTION

The assignee of the present invention is in the business of making and selling self laminating wristbands of the type shown in a number of its patents including U.S. Pat. Nos. 5,933,993; 6,000,160; 6,067,739; 6,438,881; 6,510,634; 6,748,687; 7,047,682; 7,017,293; and 7,017,294, the disclosures of which are incorporated herein by reference. While these are good and valuable inventions and have met with great commercial success, most of the wristband forms disclosed in these prior patents are directed to a market segment comprised of customers who recognize the value of the product through its superior design providing superior performance and ease of use as well as the cost savings achieved by savings of medical staff time in processing accurately and reliably the in-coming patients or others using the wristbands. There yet remain those in different market segments who for their own reasons are more closely focused on the cost of purchasing the wristband and use that parameter principally if not exclusively in making their buying decisions. For this market segment, buyers are willing to sacrifice quality, ease of use and reliability of identification/use as a trade off against initial wristband cost and buy wristbands not offering the many advantages and features of the assignee's previously patented designs.

Typical of the prior art designs bought and sold for this market segment include a simple vinyl wristband having a wider "panel" area for receiving a self adhering paper label separately printed with the wearer's name, etc., a strap portion extending to one side of the panel with a series of holes punched in the strap to allow for sizing the wristband to different lengths, and a snap closure at the other end of the panel comprised of a pin for insertion through one of the strap holes and into a receiver to secure the pin and thus complete the attachment of a wristband to a wearer's wrist or ankle. For convenience, the word "wrist" when used herein shall include any limb such as a wrist or ankle and the word "wristband" shall include bands wrapped around any limb such as either a wrist or ankle. Generally a cheap vinyl or other plastic material is used to make these wristbands, and they may be formed in sheets with adjacent wristbands being flipped end-to-end to allow them to nest and thereby save on wasted material. The snap closures are also generally made of plastic and are mounted in a "toe" vinyl extension from the panel side opposite the strap. This toe extension generally comprises a tab portion aligned with and opposite to the strap and within which the snap closure is located. The snap closure includes a pin centered along the same center axis as the strap, which centers the snap closure to the panel and strap holes so that when the wristband is applied by attaching the strap to the snap closure the strap remains aligned with the panel.

While this construction is much less expensive, it does not provide the significant benefit of a laminated protective layer over the printed wearer's name and other identifying information such as a bar code. In this prior art wristband, that information is routinely printed (or even handwritten) separately on a paper label and then the label is applied to the carrier such as with a layer of adhesive. For many medical applications, the harsh environment including exposure to bodily fluids, etc. in which these wristbands must perform often times can lead to early label failure and needed replacement, or even to errors in reading the recorded information from the label. If not timely replaced, disastrous results such as administering the wrong medication, providing the wrong or improper treatment, etc. can occur. For these reasons, in many instances the savings provided by the reduced purchase price for a single wristband is lost or even exceeded in cost when multiple wristbands are used.

To solve these and other problems in the prior art, and to provide the benefits of a wristband with laminated protection for wearer information but in a less costly product, the inventors herein have succeeded in conceiving of and developing an inexpensive wristband including a carrier onto which preferably a printed, laminated ID label may be securely mounted with an inexpensive snap closure and within the "envelope" of the underlying panel so that it is protected from contact with the user's wrist or ankle as the wristband is worn. While preferably the label or tag mounted to the wristband carrier is of the assignees own previous design of a self laminating label, it is noted that other labels could be used. The carrier includes a toe extension which unlike the known prior art designs is offset and extends further to the outside of the panel, with the pin portion of the closure mounted off the centerline of the panel and strap but positioned so that the ID label is captured between it and the fold of the toe as the receiver is folded over to fasten the closure. This arrangement provides not only automatic correct positioning of the label onto the carrier but also the additional benefit of using less material, and thus generating less waste, than if the toe were merely made longer. In this design and for this market segment, especially considering that wristbands such as these are used annually by the millions if not billions, the small but incremental cost savings achieved through this arrangement can be significant. The laminated ID label preferably has a slot at either end, one slot sized to slide over the strap and the other slot sized and located to allow centering of the ID label on the panel, it being centered by the close fit between the pin and fold in the toe extension. The use of a slot instead of a hole allows for minor tolerances in manufacturing, although many different opening sizes and shapes could be used.

Yet another feature incorporated into the present invention is a relieved edge formed along the longitudinal opposing edges of the carrier which renders the panel edge flexible and more comfortable to wear. This flexibility reduces the tendency of the edge to pinch, or dig into, the skin as a wearer moves his hand and wrist, or ankle. Instead, the relieved edge readily flexes away from the skin which reduces any abrasive or cutting effect to the skin. There are various patterns which may be used and which are contemplated by the inventor to exhibit the desired effect. Each of these patterns essentially adds yieldability, or extends the length, of the edge which provides "give" so that there is less pressure placed on the wearer's skin at the edge than in the body of the panel area.

The principal advantages and features of the invention are briefly explained above, but a more thorough understanding thereof may be gained through reading the description below while referring to the appended drawings.

DETAILED DESCRIPTION OF THE PREFERRED EMBODIMENT

Figure 1:
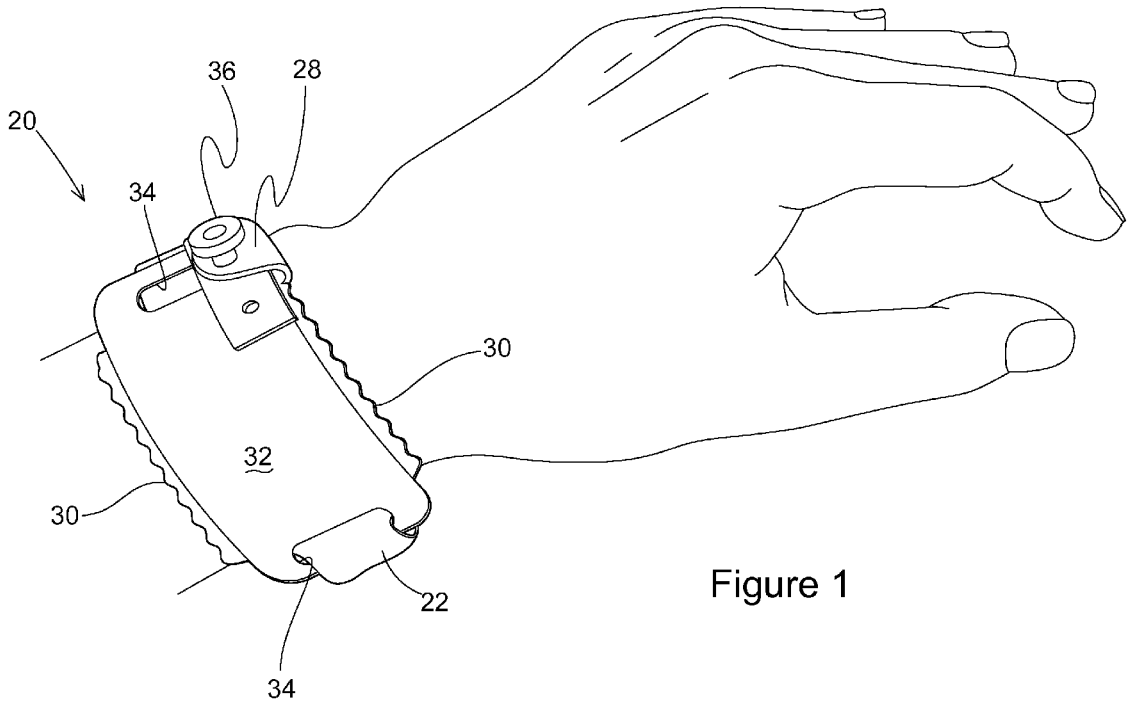
FIG. 1 is a perspective view of the wristband of the present invention assembled and worn on the limb of a user.
Figure 2:
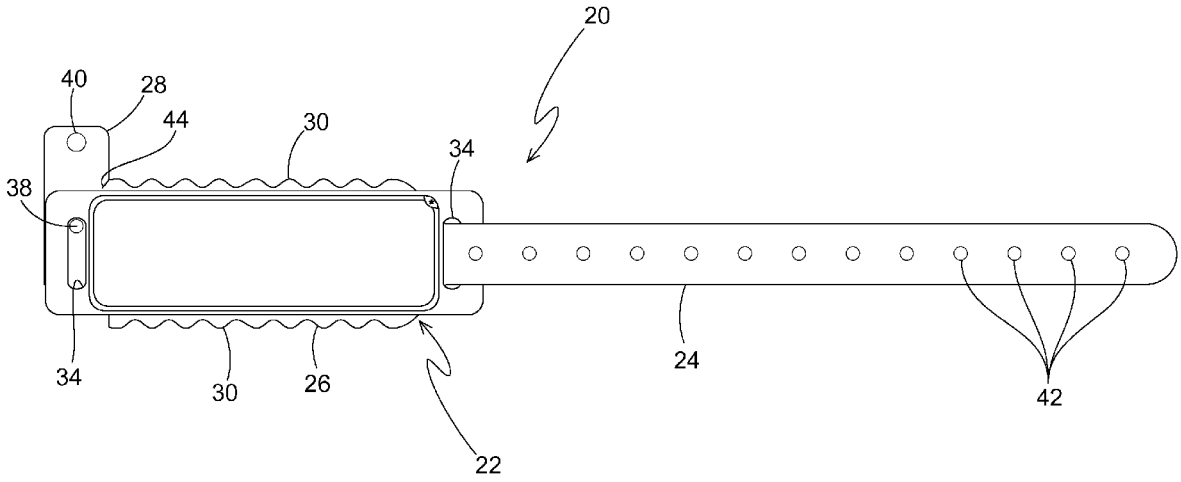
FIG. 2 is a top view of an assembled wristband, with the slotted laminated ID label slipped over the strap and the male portion of the snap closure.

As shown in FIGS. 1 and 2, the wristband 20 of the present invention comprises a carrier 22 having a strap portion 24, a panel portion 26, and a toe 28 extending to the side of the panel 26. The carrier 22 is preferably made of a thin and flexible vinyl or other suitable relatively inexpensive plastic material and preferably has a thickness of about 15-20 mil, for flexibility and cost reasons. Along an upper and lower longitudinal edge of the panel 26 is a relieved edge 30. This relieved edge takes on a generally scalloped shape extending along substantially the entirety of the longitudinal edge. As discussed below, the relieved edge 30 may have a number of alternative shapes. A self laminating ID label 32 preferably has a pair of slots 34 at opposing sides thereof, with the slots 34 preferably having approximately the same size, shape and relative placement on the label 32. The slots 34 are sized to allow the strap portion 24 to slide therethrough but not over the panel portion 26. Mounted in the toe 28 is a snap closure 36 comprised of a male or pin portion 38 and a hole or receiver portion 40. The pin 38 is shown in FIG. 2 to be just off the centerline or central axis of the strap portion 24 and panel portion 26, with the strap portion having a plurality of holes 42 for positioning within the snap closure to attach the strap portion and thereby not only secure the label 32 but also mount the wristband to the wearer's wrist or ankle. As best shown in FIG. 2, the pin 38 and slot 34 capture the edge of the label 32 so that as the receiver 40 is folded over to attach to the pin 38, the inside folded edge of the toe 28 abuts the edge of the label 32 to position the label substantially within the envelope of the panel 26. To facilitate this positioning, a slit 44 in the carrier may be provided to allow the toe 28 to bend further inboard of the relieved edge 30.

Figure 3:
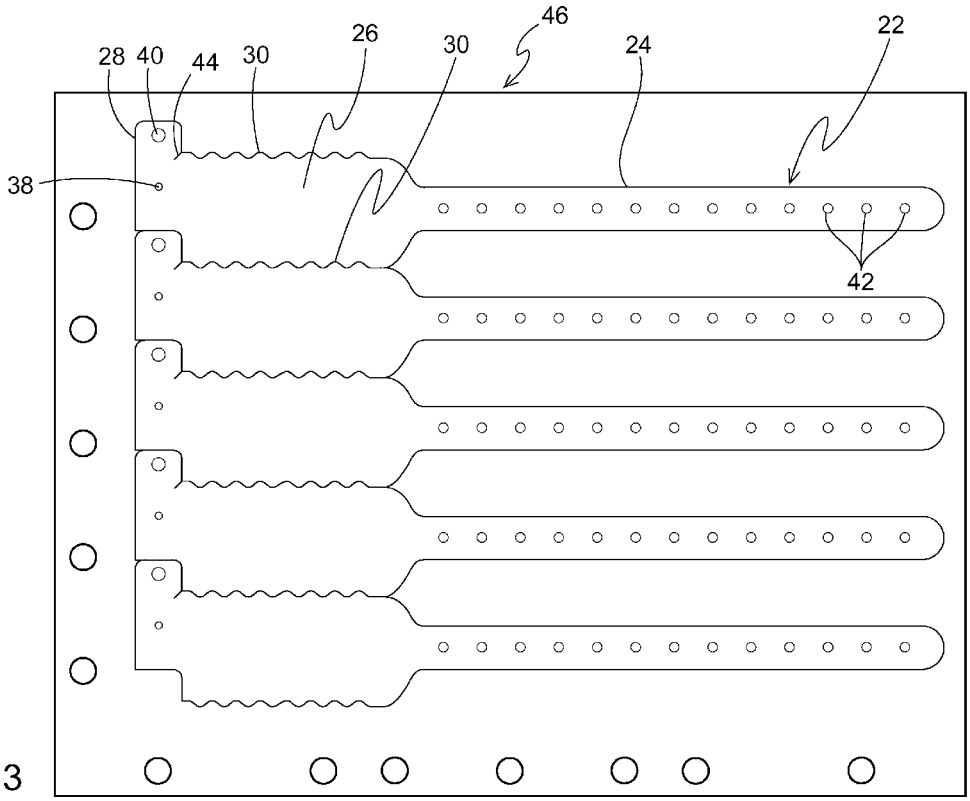
FIG. 3 is a top view of a page or sheet of a plurality of wristband carriers.

As shown in FIG. 3, a plurality of carriers 22 may be formed in a page 46, with adjacent carriers having a relieved edge 30 pattern that allows the adjacent edges to be formed with a single die cut. The carriers 22 may be conveniently formed in the page with die cuts so that the carriers may be readily separated from the page as they are used.

Figure 4:
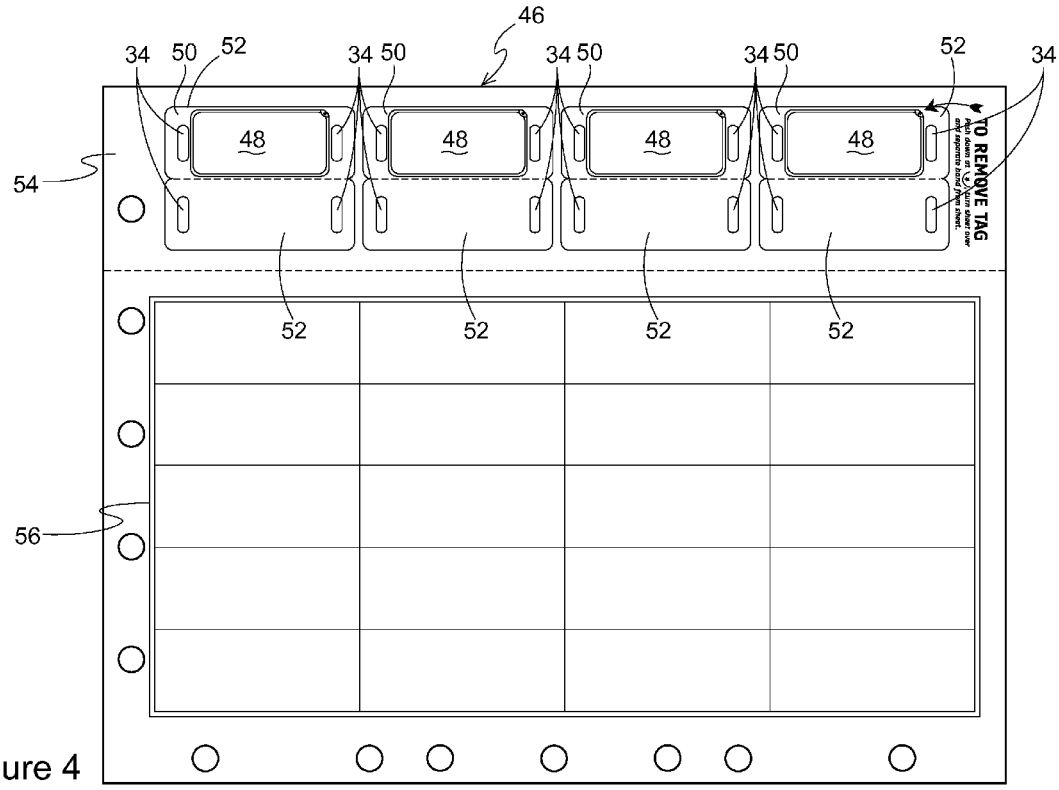
FIG. 4 is a top view of page or sheet of a matrix of self adhering labels and an upper portion having four self laminating, slotted ID labels or tags for use with the carriers as shown in FIG. 3, and FIG. 5A-5E are a series of top views each depicting a different embodiment of a relieved edge along the carrier panel edges.

As shown in FIG. 4, the laminated ID labels 32 are preferably self laminating labels of the type previously described in several of the above identified patents previously issued to the assignee hereof. Briefly, each ID label comprises a paper stock or face stock printable area 48 to which may be applied a patient's name, a bar code identifying the patient or cross referencing him to a data base, the attending doctor's name, etc. A clamshell laminating portion 50 has a pair of joined panels 52 for encapsulating the print area 48 and is formed from a transparent laminate with a pair of opposing slots in each panel 52. The panels 52 have a layer of adhesive so that after separation of the labels 32 from the page 54, and after the page 54 has been processed through a printer, the panels 52 are folded over onto each other to encapsulate the print area 48 and form the ID label for use with the carrier 22. Also as described in several of the other patents incorporated herein by reference, the page 54 may have a matrix of self adhering labels 56 which may be printed at the same time and be used on charts, etc. While a self laminating label or tag as described above is the preferred embodiment of the present invention, it is within the scope of the invention that other labels, tags could be used. These could be laminated or not. These could be rigid or flexible. These could be made of paper stock or other materials. It merely is desired that the labels, tags have the features as claimed below including one or more slots or holes or openings to accommodate mounting thereof on the carrier.

Figure 5A:
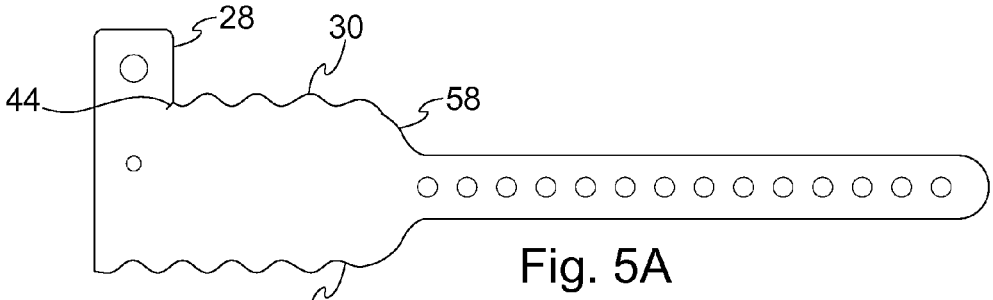
Figure 5B:
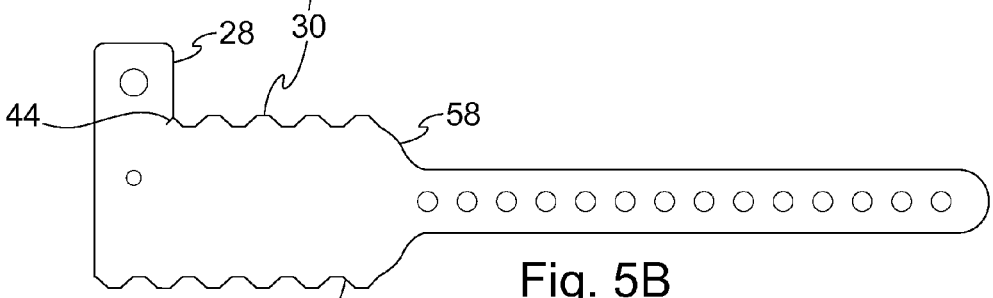
Figure 5C:
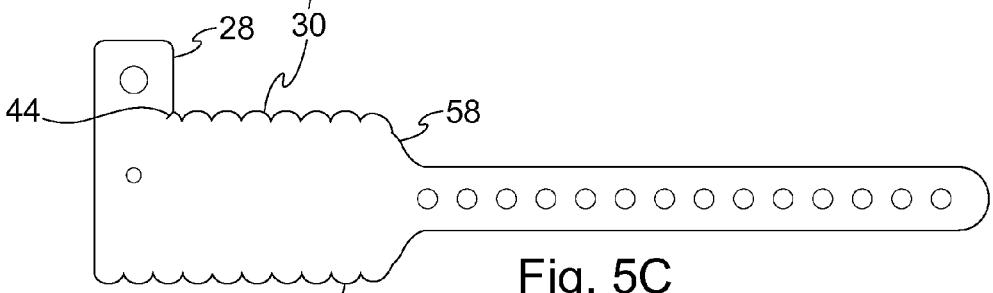
Figure 5D:
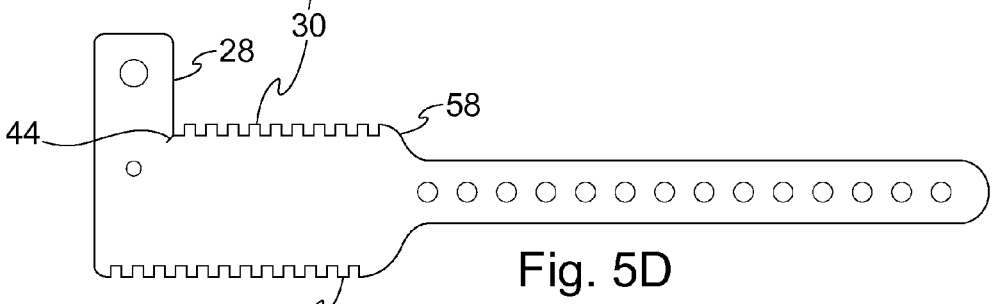
Figure 5E:
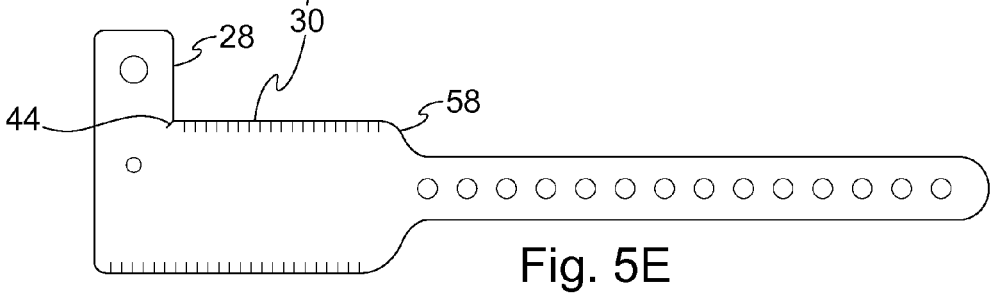

FIG. 5A-E depict different shapes and designs for the relieved edge 30 which are all believed to exhibit the desired effect, i.e. that of softening or weakening or lengthening the edge to increase the comfort of the wearer. As shown in FIG. 5A, the relieved edge may be shaped as a generous curved or scallop, preferably extending from the front shoulder 58 of the panel 26 to the toe 28 and along both the top and bottom sides or edge of the panel 26. As shown in FIG. 5B, the relieved edge 30 may be shaped as more pronounced and regular, with flattened pyramids extending outwardly. As shown in FIG. 5C, the relieved edge 30 may be shaped as a continuous half or semi-circle pattern, resembling an arrangement of petals along the edge. As shown in FIG. 5D, the relieved edge may be shaped as a Greek key, or series of spaced rectangular flaps. As shown in FIG. 5E, the relieved edge may be formed by a series of die cuts which creates a series of adjacent rectangular flaps. It is noted that several of these relieved edge designs, such as that shown in FIGS. 5A, 5B, 5D and 5E, may be conveniently arranged such as by offset to allow for adjacent positioning of carriers on the same page and the formation of the relieved edge for two adjacent carriers with a single die cut.

As disclosed and claimed herein, a low cost plastic carrier securely mounts a self laminating ID label with a snap closure and has a comfort edge to decrease any chance for injury to the wearer. The carriers are conveniently made in sheets or pages separately from the multiply construction of the ID labels which themselves are formed in sheets or pages. The principal advantages and features of the present invention have been explained in illustrative manner above. However, such explanation should be considered as merely illustrative and the invention should be considered as encompassing such alternative and supplementary variations as would be apparent to those of skill in the art. For example, the preferred embodiment discloses that the ID label has a pair of slots at opposing ends. One slot could readily be replaced by a hole, or other design opening just so long as it would permit it to be secured to the snap closure. A snap closure is disclosed although other design closures could be used and should be considered as equivalent thereto. The receiver portion has been disclosed as being mounted outboard but the male pin could be located there instead. A slit has been disclosed as assisting the toe to be folded over to locate the ID label inboard of the panel edge, but the use of a slit is considered optional, and even other structure or design could be used to the same purpose. Several designs for the relieved edge have been disclosed although others could be used to the same effect. For example, a folded over edge which would provide effectively a "bumper" could also be used. Other variations would be apparent, and the invention is intended to be limited solely by the legal scope of the claims appended hereto.

What is claimed is:

1. A carrier for a wristband, the carrier having a strap portion and a panel portion, the panel portion having a snap closure formed in a flexible toe, a separated label, said label having a first opening for capture by said snap closure and a second opening through which said strap portion is gassed to affix the label to said carrier, the label openings being positioned so that the label edges are inboard of the carrier as the label is secured thereto, said flexible toe being sized so that as it is folded over to close the snap closure a folded edge is created which substantially aligns with an edge of the panel portion to thereby position the label within a substantially continuous edge extending along one side of the panel portion.

2. The carrier of claim 1 wherein the strap portion has at least one strap hole to affix the strap portion and carrier to a wearer's limb, said snap closure being offset from the strap hole as said snap closure is closed over the strap hole, thereby canting one end of the strap portion from the panel portion.

3. The carrier of claim 1 further comprising a relieved edge formed along at least one edge of said panel portion.

4. The carrier of claim 1 wherein the label has a width smaller than the panel portion so that as the snap closure is closed the label lies substantially within the periphery of the panel portion.

5. The carrier of claim 1 wherein the label openings comprise slots positioned near opposing ends of the label.

6. The carrier of claim 1 wherein the label comprises a face stock imaging area laminated on both sides by a laminate layer.

7. The carrier of claim 6 wherein the second label slot is sized to freely slide about a pin member of the snap closure.

8. The carrier of claim 1 wherein the flexible toe extends substantially perpendicular to the strap portion and is sized so that as it is folded over to close the snap closure a fold is created to thereby substantially align with an edge of the panel portion.

9. The carrier of claim 1 wherein the strap portion has at least one hole along its length, and wherein said at least one hole is captured by the snap closure to thereby affix the wristband about the wearer's limb.

* * * * *

UNITED STATES PATENT AND TRADEMARK OFFICE

CERTIFICATE OF CORRECTION

PATENT NO. : 7,658,026 B2
APPLICATION NO. : 11/553872
DATED : February 9, 2010
INVENTOR(S) : Sanjay Jain et al.

It is certified that error appears in the above-identified patent and that said Letters Patent is hereby corrected as shown below:

On the title page item (54) and col. 1, line 1, replace "Wristband With Snap Closure And Patent Id Label" with "Wristband With Snap Closure And Patient Id Label".

Signed and Sealed this

Twentieth Day of April, 2010

David J. Kappos

David J. Kappos
*Director of the United States Patent and Trademark Office*